United States Patent [19]

Cesin

[11] 4,388,914

[45] Jun. 21, 1983

[54] CROSSBOW WITH COIL SPRING FORCE DEVELOPING MEANS FOR PROJECTING AN ARTICLE

[76] Inventor: Louie P. Cesin, 6220 SW. 20 St., Miami, Fla. 33155

[21] Appl. No.: 271,346

[22] Filed: Jun. 8, 1981

[51] Int. Cl.[3] ..... F41B 5/00

[52] U.S. Cl. ..... 124/27; 124/40; 124/35 R; 124/41 B; 124/25

[58] Field of Search ..... 124/21, 22, 25, 27, 124/26, 40, 41 R, 16

[56] References Cited

U.S. PATENT DOCUMENTS

| | | | |
|---|---|---|---|
| 3,028,851 | 4/1962 | Drake | 124/25 X |
| 3,874,359 | 4/1975 | Cesin | 124/16 |
| 4,041,927 | 8/1977 | Van House | 124/16 X |
| 4,169,456 | 10/1979 | Van House | 124/25 X |

*Primary Examiner*—Richard C. Pinkham
*Assistant Examiner*—William R. Browne
*Attorney, Agent, or Firm*—Robert K. Rhea

[57] ABSTRACT

In a crossbow an elongated casing is connected at one end with a bowstring trigger release mechanism. A pair of bowstring interconnected wings are pivotally connected to the other end of the casing with the wings being normally biased forwardly in aligned position transversely of the casing by a compression spring within the casing moving a flexible element entrained around arcuate portions of the wings longitudinally of the casing. Toggle linkage, contained by the casings, bears against one end of the compression spring to increase its article projecting potential following intital cocking of the bowstring.

4 Claims, 4 Drawing Figures

CROSSBOW WITH COIL SPRING FORCE DEVELOPING MEANS FOR PROJECTING AN ARTICLE

BACKGROUND OF THE INVENTION

1. Field of the Invention

The present invention relates to crossbows.

2. Description of the Prior Art

The most pertinent prior art is believed to be my U.S. Pat. No. 3,874,359 which discloses a crossbow having an elongated casing pivotally mounting, at one end portion, a pair of wings interconnected at their other ends by a bowstring. The casing contains a compression spring moving a follower longitudinally of the casing with the follower connected with a pair of pivoting rods projecting outwardly through the casing slots and connected with the respective wing for biasing the wings forwardly in response to a trigger release means at the other end of the casing releasing the bowstring from a cocked position.

This invention is distinctive over this patent by providing a casing contained compression spring having wings pivotally mounted at one end thereof in which a follower, moved by the compression spring, supports an elongated flexible element extending through the spring and casing and entrained at its respective ends around arcuate portions of the wings for biasing the wings toward an article projecting position when the bowstring is released from a cocked position by trigger means at the other end of the casing. A further advantage of this crossbow over the crossbow of the above named patent is a lever actuated toggle link arrangement which further compresses the force producing spring following initial cocking of the crossbow.

SUMMARY OF THE INVENTION

An elongated tubular casing forms the barrel portion of a pistol-type gun stock having trigger means for holding and releasing a bowstring. A bracket is transversely secured to the forward end portion of the casing. A pair of wings are pivotally connected at one end portion to the respective end portions of the bracket for pivoting movement of the wings in a horizontal plane. The outwardly projecting end portion of the wings are interconnected by a bowstring moved rearwardly of the casing, at its medial portion to the trigger means, for pivoting the bowstring connected end portions of the wings in a rearward direction toward opposing sides of the casing when the crossbow is in cocked position. A peripheral portion of each wing, at its bracket connected end portion, describes an arcuate convex curve. Intermediate its ends, the casing contains an elongated compression spring. A follower block within the casing abuts the rearward end of the compression spring. An elongated flexible element is entrained medially its ends across the follower block and extends forwardly through the spring and is entrained at its respective end portions around the concave surfaces of the respective wings and is connected therewith at a point spaced forwardly of the wing to bracket connection. The forward end of the compression spring abuts a toggle link means contained by the casing and operated by a lever normally depending from the casing for increasing the compression of the spring following engagement of the bowstring with the trigger means.

The principal object of this invention is to provide a crossbow having a trigger equipped crossbow string holding and releasing means in which a casing contained compression spring biases, by a flexible element, a pair of wings in opposing directions for projecting a projectile forwardly and which further includes toggle linkage for increasing the compression potential of the spring following the initial bowstring cocking action.

DESCRIPTION OF THE PREFERRED EMBODIMENT

Figure 3:
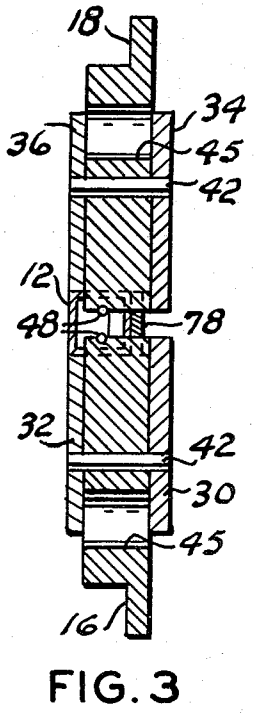
FIG. 3 is a vertical cross sectional view taken substantially along the line 3—3 of FIG. 1; and, FIG. 4 is a vertical cross sectional view taken substantially along the line 4—4 of FIG. 1 with the crossbow in cocked position and illustrating movement of the trigger means and toggle linkage by dotted lines.
Figure 1:
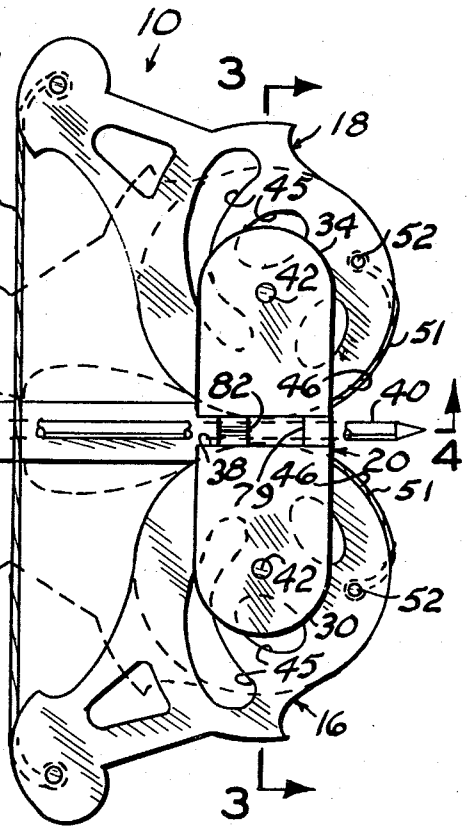
FIG. 1 is a top view of the crossbow illustrating, by dotted lines, the wings in cocked position and the relative position of a quarrel.
Figure 2:
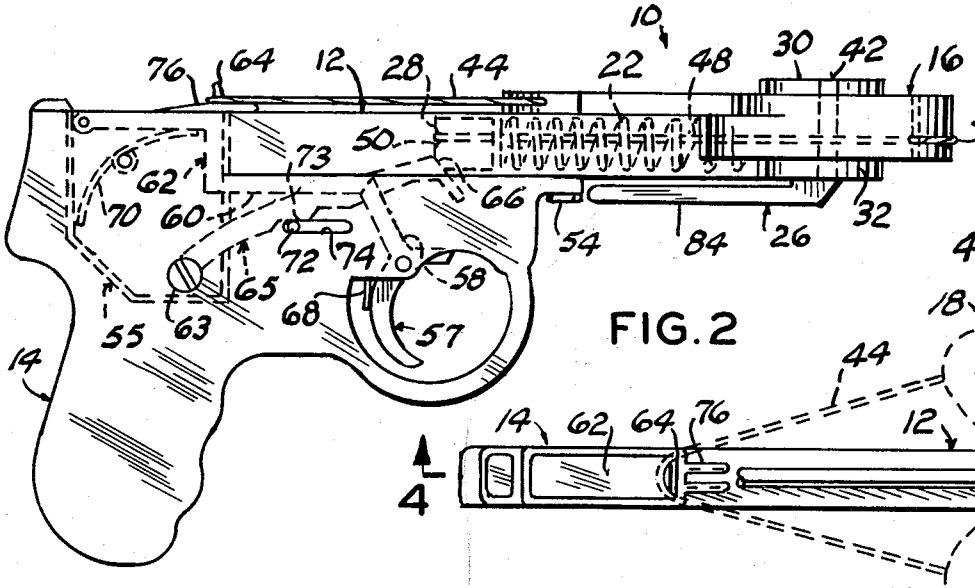
FIG. 2 is a side elevational view of the crossbow in cocked position.
Figure 4:
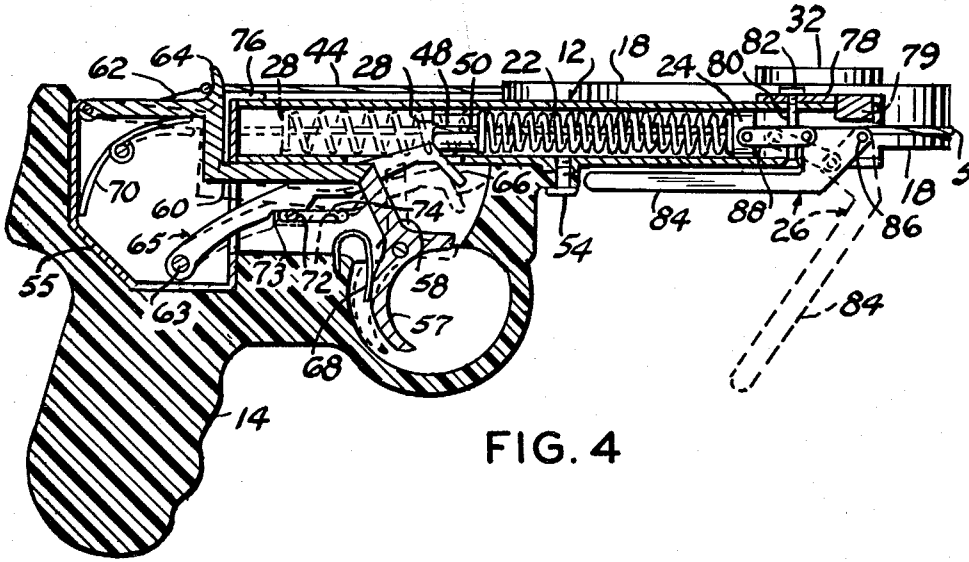

Like characters of reference designate like parts in those figures of the drawings in which they occur.

The reference numeral 10 indicates the crossbow which is generally pistol-like in side elevation comprising an elongated casing 12 having a pistol stock 14 secured to and closing its rearward end and having a pair of wings 16 and 18 connected to its other end portion by bracket means 20.

The casing 12 is elongated tubular and contains intermediate its ends a helical compression spring 22. The forward end of the spring 22 abuts a movable stop 24 forming a part of the toggle linkage means 26, as presently explained.

The rearward end of the compression spring abuts a follower 28 longitudinally slidable in the casing 12, as presently explained.

The bracket means 20 comprises right and left pairs of vertically spaced ears 30,32 and 34,36 secured to opposing sides of the forward end portion of the casing 12 in transverse horizontal alignment with the confronting ends of the upper pair of ears 30 and 34 disposed in spaced-apart relation to define a slot 38 longitudinally aligned with the casing in which the forward end portion of an arrow or quarrel 40 is disposed. The respective pair of ears are vertically apertured for journalling one end portion of the wings 16 and 18, respectively, for pivoting movement about the vertical axis of hinge pins 42. The other end portion of the wings are connected with the respective ends of a bowstring 44. The wings 16 and 18 are characterized by a plurality of vertical lightening apertures 45 to reduce their mass and an arcuate part-circular surface 46 on their end portion journalled by the pins 42 with the arcuate surfaces 46 intersecting the lateral planes of the casing wall.

An elongated flexible strand 48 is doubled back upon itself medially its ends and extends longitudinally through the spring 22 from its forward end with the medial portion of the strand 48 entrained around the follower 28 within a groove 50 therein. The respective end portions 51 of the strand 48 are entrained around the arcuate surface 46 of each wing within a suitable groove formed therein and are secured to the forwardly disposed edge portion of the respective wing by pins 52. The length of the strand 48 is such that it permits substantially full expansion of the spring 22 within the limits of the casing to normally maintain the wings 16 and 18 in a spread-apart position with a slight tension on the bowstring 44.

The pistol grip 14 has an upper hollow portion defined by opposing side walls and may be formed integral with the casing or formed separately and attached thereto as by a screw 54. The grip 14 contains a bowstring release case 55 disposed at the rearward end of the casing. The grip 14 includes a trigger 57 having an arm portion 58 frictionally contacting the forward end surface of a forwardly extending leg 60 of a vertically movable bowstring latch 62 supported at its other end by the case 55 and having a string catch 64 projecting above the horizontal limit of the grip and casing around which the medial portion of the bowstring 44 is entrained when the crossbow is cocked. An elongated bar, supported at one end for vertical pivoting movement of its other end portion by a transverse screw 63, projects forwardly out of the case 55 and extends upwardly into the casing 12 at one side of the latch leg 60 to form a safety stop 65 having an inclined forward leg portion 66 normally abutting the rearward end surface of the follower 28 when the crossbow is in a cocked position.

A trigger spring 68 is interposed between the trigger 57 and the trigger guard to normally maintain the trigger arm 58 in position for contact with the forward end surface of the latch arm 60. A spring 70 normally biases the string latch 62 to a raised position after releasing the bowstring 44 in response to pulling the trigger 57, as presently explained.

A safety pin 72 extends transversely through the side walls of the pistol grip 14, in the path of downward movement of the safety stop 65 and is forwardly and rearwardly slidable within cooperating slots 74 formed in the side walls. In its rearward position the safety pin 72 underlies a land 73 on the stop 65 to prevent downward movement thereof and release of the bowstring 44 and spring 22. The safety pin is manually moved to its forwardmost position to permit downward movement of the stop 65 for firing the crossbow.

An arrow setting support member 76 overlies the pistol grip portion in surrounding and forwardly projecting relation with respect to the string catch 64 for supporting the rearward end of the arrow or quarrel. An L-shaped magnetic bracket 78, having a permanent magnet 79 secured to its depending surface, overlies the forward end portion of the barrel within the slot 38 and is secured to the barrel by a bolt 80 extending vertically therethrough with the upper end of the bolt transversely arcuately recessed to form a groove 82 for supporting an intermediate portion of the arrow 40.

The toggle linkage 26 comprises a lever 84 pivotally connected at one end by a pin 86 projecting transversely through the casing 12 forwardly of the bolt 80 with the other end of the lever normally depending from the casing through a suitable slot therein. A toggle link 88 pivotally connects the handle 84 with the toggle link stop 24. The purpose of the toggle linkage is to further compress and increase the tension on the spring 22 following initial cocking of the crossbow and the force applied to the arrow when the crossbow is fired.

OPERATION

In operation, the crossbow is initially cocked by manually disposing the medial portion of the bowstring 44 behind the catch 64 which compresses the spring 22. The spring is then further compressed by manually pulling the depending end portion of the toggle lever 84 rearwardly to underlie the casing 12. The arrow 40 is then positioned on the casing on the arrow setting member 76 and bolt end groove 82. After the safety pin 72 is released, the crossbow is ready to fire. When the trigger 57 is manually pulled rearwardly out of contact with the latch arm 60, the tension of the spring 22, applied to the bowstring 44 through the wings 16 and 18, pivots the latch 62 downwardly to release the bowstring and propel the arrow forwardly to a target, not shown. During this action the follower 28 biases the forward end portion of the stop 65 downwardly.

Obviously the invention is susceptible to changes or alterations without defeating its practicability. Therefore, I do not wish to be confined to the preferred embodiment shown in the drawings and described herein.

I claim:

1. A crossbow, comprising:

a casing having a forward end and a rearward end;

wing mounting bracket means transversely connected to the forward end portion of said casing for pivoting mounting a pair of wing;

a pair of wings respectively connected, at one end portion, to respective end portions of said bracket means for pivoting movement of their other end portions toward and away from said casing;

said one end portion of each wing of said pair of wings having a part-circular convex surface;

a bowstring extending between and connected with said other end portions of said wings;

an elongated compression spring longitudinally disposed within said casing;

movable stop means within the forward end portion of said casing for limiting forward movement of said compression spring;

a follower longitudinally slidable within said casing and abutting the rearward end of said compression spring;

elongated flexible strand means extending longitudinally within said casing and connected with said follower, the forward end portion of said strand means extending around a peripheral portion of the respective convex wing surface and connected with the respective wing forwardly of said bracket means for transferring a biasing force exerted by said compression spring, when the later is compressed, to said other end portion of said wings in a forward direction to pivot the wings forwardly and cause the bowstring to exert a force on a projectile and project a projectile forwardly;

a pistol grip member connected with and closing the rearward end of said casing; and, trigger means supported by said pistol grip member to permit a member holding the cocked bowstring to flex downwardly under the force of the bowstring and release said bowstring.

2. The crossbow according to claim 1 in which said movable stop means for limiting forward movement of said compression spring comprises:

a stop member longitudinally slidable within said casing and abutting the forward end of said compression spring;

toggle link means interposed between said stop member and the forward end of said casing for moving said stop member rearwardly, said toggle link means comprising a toggle lever depending from and pivotally connected at its upper end with the forward end portion of said casing for pivoting movement of its other end portion toward and away from the rearward end portion of said casing; and, a toggle link extending between and pivotally connected with said stop member and an intermediate portion of said toggle lever.

3. The crossbow according to claim 1 or 2 in which said trigger means for releasing said bowstring from crossbow cocked position comprises:

a trigger having a trigger arm projecting upwardly and rearwardly within said pistol grip member;

a string latch supported within said pistol grip member and having a vertically movable end portion normally frictionally contacting said trigger arm;

string latch resilient means biasing said string latch toward an upward bowstring engaging position;

a safety stop bar having a vertically movable end portion normally projecting into the rearward end portion of said casing and abutting the rearward end of said follower when the crossbow is in cocked position; and, other resilient means normally biasing said trigger forwardly.

4. The crossbow according to claim 3 and further including:

movable safety pin means slidably supported by said pistol grip member for normally preventing downward movement of said safety stop bar to a compression spring released position.

* * * * *